United States Patent [19]

Hunter

[11] Patent Number: 4,983,848

[45] Date of Patent: Jan. 8, 1991

[54] SURFACES FOR X-RAY INTENSIFYING SCREENS

[75] Inventor: Susan J. Hunter, Hockessin, Del.

[73] Assignee: E. I. du Pont de Nemours and Company, Wilmington, Del.

[21] Appl. No.: 337,157

[22] Filed: Apr. 12, 1989

[51] Int. Cl.[5] ..... G21K 4/00

[52] U.S. Cl. ..... 250/483.1; 378/173

[58] Field of Search ..... 250/483.1; 378/173

[56] References Cited

U.S. PATENT DOCUMENTS

| | | | |
|---|---|---|---|
| 2,648,013 | 8/1953 | Smith | 250/488.1 |
| 2,819,183 | 1/1958 | Alles | 428/215 |
| 2,907,882 | 10/1959 | Patten | 428/481 |
| 3,043,710 | 7/1962 | Patten et al. | 428/215 |
| 3,895,157 | 7/1975 | Brixner et al. | 428/220 |
| 4,059,768 | 11/1977 | Van Landeghem et al. | 250/483.1 |
| 4,225,653 | 9/1980 | Brixner | 428/539 |
| 4,387,141 | 6/1983 | Patten | 428/690 |
| 4,572,955 | 2/1986 | Teraoka et al. | 250/483.1 |
| 4,733,089 | 3/1988 | Kitada et al. | 250/483.1 |
| 4,855,191 | 8/1989 | Arakawa et al. | 428/690 |

*Primary Examiner*—Constantine Hannaher

[57] ABSTRACT

X-ray intensifying screens that can be conveniently and easily used in book cassettes and automatic changer systems are described. These screens have an improved surface made by bonding a thin, clear, transparent, tough, flexible, dimensionally stable polyamide film thereon. The screens display a very low average dynamic coefficient of friction, very good resistant to wear (e.g., gouging and abrasion) and a low static susceptibly which permits long term use in book cassettes and rapid handling incurred in said changer systems.

10 Claims, 1 Drawing Sheet

SURFACES FOR X-RAY INTENSIFYING SCREENS

DESCRIPTION

1. Field of the Invention

This invention relates to the field of X-ray intensifying screens. More particularly, this invention relates to X-ray intensifying screens which have an improved polyamide surface or topcoat layer which are used in conjunction with photographic films to produce an image thereon.

2. Background of the Invention

It is known that various solution coated topcoats or surface films can be placed over an X-ray intensifying screen. These topcoats and films are designed to improve and protect the phosphor-binder layer and assist in the processability of the X-ray intensifying screen in various ways. To produce an image, film is placed in contact with screens. The mechanism for doing this varies with the equipment used. These X-ray intensifying screen surfaces do not always provide long-term protection in book cassettes, and are particularly short-lived when used within the modern, automatic systems now found in the busier radiographic sections of modern hospitals. For example, screens and magazines of X-ray films are loaded by hospital staff personnel in an automatic changer, and from that point on, work can be done in ordinary, white light. The appropriate screen matched with the appropriate photographic film elements present in the changer are then exposed as required. Then, the magazine of exposed X-ray film is removed for film processing and a magazine of unexposed X-ray film is put back into the system. A disadvantage with this automatic system, particularly since the X-ray intensifying screen is an expensive part of the overall system, is that considerable stress is placed on the screen and it is required that the surface thereof be tough and durable to survive automatic handling (e.g. X-ray photographic films rubbing over the screen surface, mechanical parts, etc.) and not develop imageable artifacts. Additionally, there is a need to reduce the static which can build up within this automatic equipment as films slide against screens during the handling. As is well known any static produced can cause unwanted film exposure and subsequent handling problems. Thus, there is a pressing need to develop X-ray intensifying screens that can survive multiple uses within the modern, automatic changers, for example.

It has been found that the above disadvantages can be overcome and an improved X-ray intensifying screen provided by bonding a thin, clear, transparent, tough, flexible film of the invention to the surface of a supported phosphor containing layer.

SUMMARY OF THE INVENTION

In accordance with this invention there is provided an X-ray intensifying screen comprising a support having thereon a phosphor-binder layer, and a polymeric film adhered to the phosphor-binder layer, the improvement wherein bonded to the phosphor-binder layer is a clear, transparent, flexible, tough, dimensionally stable polyamide film having a thickness of no greater than about 15.2 μm, the X-ray intensifying screen having an average dynamic coefficient of friction in the range of 0.15 to 0.25 and low static susceptibility when the screen is used within a book cassette or an automatic changer therefor.

BRIEF DESCRIPTION OF THE DRAWINGS

In the accompanying drawings forming a material part of this disclosure.

DETAILED DESCRIPTION OF THE INVENTION

Figure 1:
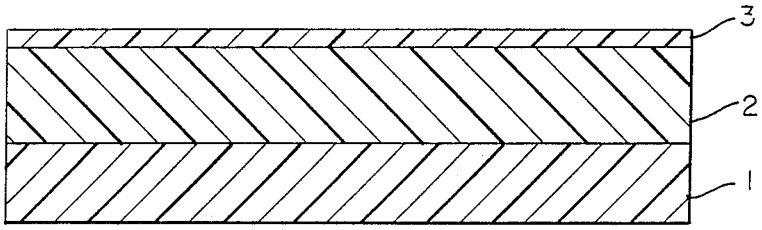
FIG. 1 shows a typical X-ray screen element of this invention.

Referring now specifically to FIG. 1, 1 is a typical support conventionally used in the manufacture of X-ray intensifying screen elements. Typical X-ray screen supports include paper or cardboard suitably sized or coated with baryta, for example, films such as polyethylene terephthalate (preferred), cellulose acetate, cellulose propionate, cellulose acetate propionate, cellulose acetate butyrate, poly(vinyl chloride or vinyl acetate), and polyamides, among others, as well as thin metals or foils, etc. For use as an X-ray screen, the support must be permeable to X-rays. A thickness of about 0.00025 inch (0.00064 cm) to about 0.30 inch (0.76 cm) is adequate for these supports, with a thickness of about 0.01 inch (0.025 cm) being preferred. These supports may contain reflecting agents such as $TiO_2$ dispersed therein, for example. Alternatively, the reflecting material may be applied on the support as a separate layer. Likewise, other adjuvants such as absorbing dyes, etc., may be useful within the support of the screen element of this invention. Preferably the support is a thin yet strong, dimensionally stable polyethylene terephtahalate of about 0.004–0.12 inch (0.1–0.3 mm) in thickness, although other thicknesses are also satisfactory.

The phosphor containing layer 2 conventionally contains the phosphor particles dispersed in an appropriate binder. The phosphor materials are usually mixed in the desired amount in an appropriate solvent, e.g., a mixture of n-butyl acetate and n-propanol, etc., and the resulting solution is mixed with a suitable binder, e.g., polyvinyl butyral, etc., to form a suspension. This suspension is coated on any of the aforementioned supports or alternatively on the polyamide film protective layer. Dispersion of the phosphor in any one of a legion of conventional binders can be accomplished by ball-milling and by other procedures well known to those skilled in the art, for example, U.S. Pat. Nos. 2,648,013; 2,819,183, 2,907,882; 3,043,710; and 3,895,157, the disclosures of which are incorporated herein by reference. Useful phosphors are also legion in number and include, for example, the tungstates of calcium and magnesium, including those activated by lead; terbium activated rare earth metal oxysulfide type phosphors such as $Y_2O_2S$:Tb, also those of lanthanum and those activated by Tm, and $Gd_2O_2S$ type phosphors; terbium activated rare earth phosphate phosphors such as $YPO_4$:Tb and those of gadolinium and lanthanum; rare earth oxyhalide type phosphors such as LaOBr:Tb and those activated with thulium; barium sulfate type phosphors such as BaSO4:Pb and those activated with europium and also containing strontium; also to be mentioned are the europium activated alkaline earth metal phosphor type phosphors and the divalent europium activated alkaline earth metal fluorohalide type phosphors; iodide type phosphors and sulfide type are also known. Still other phosphor compositions include the mixed $CaWO_4$ rare earth tantalate phosphors of Patten, U.S Pat. No. 4,387,141 as well as the tantalate phosphors of Brixner, U.S. Pat. No. 4,225,653, the disclosures of which are incorporated herein by reference.

The protective layer 3 is the improvement of this invention. Although it is known to use laminated films as protective layers in X-ray screen elements, it is not known to use thin, clear, transparent, flexible, tough, dimensionally stable (stretched and annealed) polyamide films having a low dynamic coefficient of friction and low static bonded to the phosphor-containing layer. These polyamide films are conventionally synthesized and have a thickness of about 2.5 μm to 15.2 μm, and preferably about 2.5 μm to 12.7 μm. Illustrations of polyamide films include: crystalline types, e.g., nylon 6,6, $-[HN-(CH_2)_6-NH-OC-(CH_2)_4-CO-]_n$; nylon 6, $-[CH_2-)_5-CO-NH-]_n$; nylon 12, 12, etc.; amorphous types, e.g., Selar® PA 3426. E. I. du Pont de Nemours & Co., etc.; and blends thereof. The polyamide films may be bonded to the phosphor-binder layer 2 with or without an adhesive material. For example, the phosphor-binder layer can be coated on a surface of the polyamide film or the polyamide film may be extruded onto the surface of the phosphor-binder layer. It may be useful, however, to also use an adhesive material in the above bondings.

The adhesive material, when used, may be applied directly on the surface of phosphor-containing layer 2 or, alternatively, may be applied directly or indirectly to the polyamide topcoat 3 prior to lamination of the structures to achieve the X-ray intensifying screen element of this invention as shown in FIG. 1. Conventionally used adhesives may be used within the metes and bounds of this invention. Useful adhesives include: water soluble acrylic adhesives, solvent soluble acrylic adhesives produced under the tradename Carboset® of B. F. Goodrich, Co., Specialty Polymers & Chemicals Division, Cleveland, Ohio, solvent soluble polyester adhesives such as produced by Whittaker Corp., Dayton Chemicals Div., W. Alexandria, Ohio, solvent soluble polyester polyurethane, water soluble vinyl chloride copolymer, etc. Examples of solvents are methylene chloride, ethyl acetate, butyl acetate methanol, isopropanol, etc. I prefer using Carboset® XPD-1294, a high molecular weight carboxylated polymer in ethyl acetate, made by the aforesaid B. F. Goodrich Co. and applying same directly or ndirectly to the polyamide film prior to lamination of the phosphor layer of this invention thereto. Care must be taken to minimize the effect of adhesive thickness and light absorption on subsequent image quality. A useful dry adhesive thickness range is about 1–8 μm when measured on the surface of the polyamide film.

In the practice of this invention, the X-ray screen element produced containing the polyamide protective layer must perform well within, for example, book cassettes, automatic changers and other automatic systems used within the hospital environs. Examples of such automatic changers include but are not limited to Canon Film Changer Model CFC-U1, Schonander AOT Model DST-893R, Du Pont CDS Compact Daylight System Model WH-29, and Du Pont MDS Modular Daylight System Model C-345. If the COF of the screen is too high, the screens show increased wear when used in association with the aforementioned automatic changers. In addition, the screen must have a low propensity for the buildup of static in order that photographic films associated therewith are not needlessly exposed and are easily removed from within the aforementioned automatic changer in order to process same to the requisite image. Thus, there is a pressing need to balance the toughness of the protective surface of the screen and to insure that no static is built up during the handling process. The polyamide film topcoats of this invention, surprisingly of all the known topcoat films, will produce this delicate balance of reduced COF, toughness to resist gouging and abrasion, and low propensity to produce static.

Figure 2:
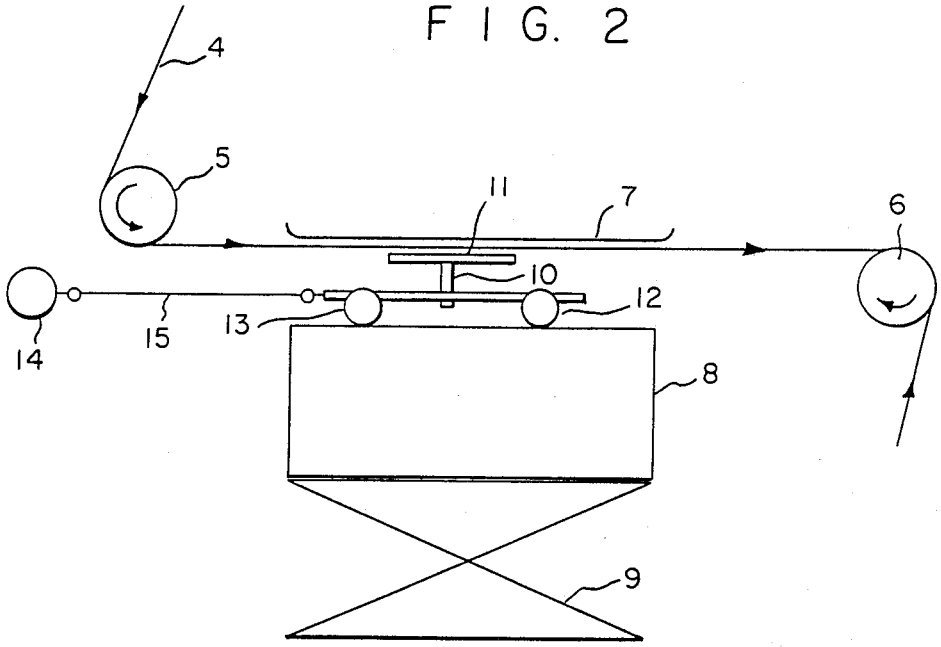
FIG. 2 shows a particular device for the measurement of the dynamic Coefficient of Friction (COF) of an X-ray intensifying screen in a screen/X-ray film combination.

FIG. 2, illustrates a device for the measurement of COF within this medical X-ray invention, wherein 4 is a continuous web of film (E. I. du Pont de Nemours and Company, Wilmington, Del. Cronex® medical X-ray film, 4 inches (10.16 cm) in width), traveling in the direction shown and pulled by rollers 5 and 6 under a pressure plate 7. Film speed is set, for the test of this invention, at ca. 130 inches (330.2 cm)/minute. The screen to be tested (not shown in FIG. 2) is placed on Load Scale 8 which can be adjusted from 0–21 pounds of pressure ($0–9.34\times10^6$ dynes) by adjusting device 9. The screen is placed on table 10 at 11 said table borne by a pair of rollers shown as 12 and 13. A Friction Scale 14 is attached thereto by means of a wire 15. As the film 4 is passed over the screen surface at 11 the testing pressure expressed in pounds (dynes) is applied and the friction force vs load and slip speed measured at 14. Thus, for any particular screen, the COF can be calculated from various friction forces and loads and a determination made of the amount of damage occurring to the surface thereof. Polyamide films of this invention with average COF limits of from about 0.15 to 0.25 and preferably from about 0.15 to 0.22 produce adequate surfaces for the protection of the screens of this invention.

Propensity to generate static can be measured using a Monroe Static Charge Analyzer, Model 276A (Monroe Electronics, Inc., Lyndonville, N.Y.), for example. This instrument is used to measure the time to reach ½ of the initial charge to the surface for screen samples equilibrated at 70° F. and 60% RH (relative humidity). Each screen sample surface is cleaned by wiping with isopropanol or other appropriate cleaner, drying well, equilibrating and then testing. Surfaces are also tested after wiping with an antistatic solution (e.g., Du Pont Cronex® Screen Cleaner) followed by drying and equilibrating. Samples are charged to a maximum of 2000 volts for 10 seconds and the charge decay with time is recorded. Isopropanol cleaned surfaces which have an average static decay ½ time less than 6.0 at 60% R.H. are preferred and surfaces which have an average decay ½ time less than 3.0 seconds at 60% R.H. are most preferred.

Thus, it should be apparent, only thin, clear, tough, transparent and flexible polyamide films as defined will function within this invention. Other film elements, when compared to those of this invention, fail for a number of reasons. Most do not possess the required COF and toughness to provide protection against wear, or static protection. Other topcoat films cannot be applied as a thin layer, are not transparent or are colored and thus are not satisfactory as X-ray intensifying screen protective layers. This will be illustrated in the Examples set out below, of which Example 4 is considered to be a preferred mode of this invention.

EXAMPLES

The following examples illustrate but do not limit the invention.

EXAMPLE 1

Sixteen (16) screens were made with a structure as shown in FIG. 1 except for the topcoat films. In each case, a topcoat film was applied according to Table 1 below using various currently available surface materials. The phosphor layer comprises $YTaO_4$:Nb phosphor dispersed in a polyacrylate binder. Various tests were run on each sample to test for the average COF using the equipment described above, and for susceptibility to static as described above. In these samples, the various surfaces comprise materials with formulations and manufacturers as shown in Table 2 below. Other unusual observations such as static, thickness and transparency were also made with the results set out in Table 1 below:

TABLE 1

| Topcoat Film | Average COF | Remarks |
|---|---|---|
| Polyamide, Nylon 6,6 | 0.20 | Low Static, High Transparency |
| Polyamide, Nylon 6 | 0.20 | Same as Above |
| Polyethylene Terephthalate Film | 0.15 | High Static |
| Polyimide Film | 0.17 | Yellow Color |
| PVDC-PP-PVDC Film[1] | 0.25 | Too Thick, Low Transparency |
| Polycarbonate[2] | 0.28 | Too Thick, COF Too High |
| PVDC/PVC | 0.33 | COF Too High |
| Teflon ® PFA | 0.28 | COF Too High |
| Teflon ® FEP | 0.31 | COF Too High |
| Tedlar ® PVF | 0.31 | COF Too High |
| Polypropylene | 0.33 | COF Too High |
| Tyril ® Extruded | 0.33 | COF Too High |
| Polyethylene | 0.34 | COF Too High |
| Polyurethane | 0.66 | COF Too High |
| Spray Coated Teflon ® | 0.63 | COF Too High |

TABLE 1-continued

| Topcoat Film | Average COF | Remarks |
|---|---|---|
| Solution Coated Tyril ® | 0.35 | COF Too High |

[1]thickness 19.1 μm
[2]thickness 25.4 μm

As can be seen from the above results, only the topcoat film made from polyamides having the requisite limitations of this invention provided high quality X-ray intensifying screen elements with good COF, high transparency, low static and no physical deficiencies noted. All of the remainder had severe problems of at least one type.

TABLE 2

| Film Samples Tested | General Structure | Manufacturer |
|---|---|---|
| Polyamide | Crystalline, Amorphous, Blends | Du Pont, Allied |
| PET | $-[-O-CH_2-CH_2-O-OC-C_6H_4-CO-]_n-$ | Du Pont, Toray |
| Polyimide | 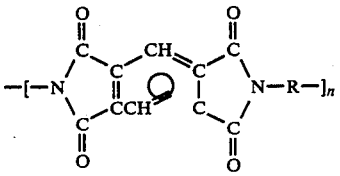 where R = aromatic | Du Pont |
| PVDC-PP-PVDC Film | $-[-CH_2-CCl_2-]_n-$ for the outer layer | Hercules |
| Polycarbonate | $-[-R-O-CO-O-]_n-$ where R = aromatic | General Electric |
| PVDC/PVC | $-[-CH_2-CCl_2-]/[-CH_2-CHCl]-$ copolymer | Dow Chemical |
| Teflon ® PFA | $-]-CF_2-CF_2-]/[-CF_2-CF(OR)-]-$ copolymer | Du Pont |
| Teflon ® FEP | $-[-CF_2-CF_2-]/[-CF_2-CF(CF_3)-]-$ copolymer | Du Pont |
| Tedlar ® PVF | $-[-CF_2-CF_2-]_n$ | Du Pont |
| Polypropylene | $-[-CH_2-CH(CH_3)-]_n$ | ICI, Hercules, Mobil, Toray |
| Polyethylene | $-[-CH_2-CH_2-]_n$ | Du Pont |
| Polyurethane | Polyester type<br>Polyether type | J. P. Stevens, Deerfield, Dow Chemicals |
| Spray-Coated Polyimide | — | Du Pont |
| Solution Coated or Extruded Tyril ® | $-[-CH_2-CH(C_6H_5)-]/[-CH_2-CH(CN)-]-$ copolymer | Dow Chemical |

EXAMPLE 2

In this example, polyamide topcoat films which meet the general definition of this invention were applied over phosphor layers made as described in Example 1. Nylon 6 and nylon 6,6 films of varying thickness were used. Only those with thicknesses of 15.2 μm or less functioned within the ambit of this invention. The remainder were too thick and thus produced poor results with photographic elements exposed therewith.

TABLE 3

| Sample | Film Thickness (μm) | Remarks |
|---|---|---|
| Nylon 6,6 | 7.8 | Best Image Resolution |
| Nylon 6,6 | 12.2 | Good Image Resolution |
| Nylon 6,6 | 15.2 | Marginal Image Resolution |
| Nylon 6,6 | 25.4 | Inadequate Image Resolution |
| Nylon 6 | 12.2 | Good Image Resolution |

EXAMPLE 3

Various adhesive materials were tried successfully in this experiment. These were tried either on top of the phosphor layer (see Example 1) or applied directly to the polyamide layer which was a 7.8 μm thick film of Nylon 6,6. The results for application to the polyamide layer are shown in Table 4, below:

TABLE 4

| Sample | Adhesive Used | Adhesion |
|---|---|---|
| 1 | Robond ® LEC-58[1] | Good |
| 2 | Robond ® PS-60[2] | Good |
| 3 | Carboset ® XPD-1117[3] | Very good |
| 4 | Carboset ® XPD-1246[4] | Very good |
| 5 | Carboset ® XPD-1294[5] | Excellent |
| 6 | Carboset ® 531[6] | Good |
| 7 | Whittaker 46960[7] | Very good |
| 8 | Whittaker 56065[8] | Very good |
| 9 | Rhoplex ® AC201[9] | Poor |
| 10 | Adhesive E-2067[10] | Very good |
| 11 | Tycel ® 7909/7283[11] | Very good |
| 12 | Geon ® 57612[12] | Poor |

[1]acrylic, water soluble, pressure sensitive, Rohm & Haas, Philadelphia, PA
[2]acrylic, water soluble, pressure sensitive, Rohm & Haas, Philadelphia, PA
[3]acrylic, solvent soluble, B. F. Goodrich, Cleveland, OH
[4]acrylic, solvent soluble, thermoset, B. F. Goodrich, Cleveland, OH
[5]acrylic, solvent soluble, B. F. Goodrich, Cleveland, OH
[6]acrylic, water soluble, thermoset, B. F. Goodrich, Cleveland, OH
[7]polyester, solvent soluble, Whittaker Corp., W. Alexandria, OH
[8]polyester, solvent soluble, Whittaker Corp., W. Alexandria, OH
[9]acrylic, water soluble, thermoplastic, Rohm & Haas, Philadelphia, PA
[10]acrylic, water-borne, pressure sensitive, Rohm & Haas, Philadelphia, PA
[11]modified aliphatic polyester polyurethane, Lord Corp., Erie, PA
[12]plasticized vinyl chloride copolymer, B. F. Goodrich, Cleveland, OH

EXAMPLE 4

A commercial grade, dimensionally stable, polyethylene terephthalate film of ca. 0.010 inch (0.25 mm) thickness and filled with $TiO_2$ to provide reflection, was used as support 1 to prepare the screen of this example. $YTaO_4$:Nb phosphor dispersed in an acrylic polymer binder was applied thereon as layer 2, 0.006 inch (0.15 mm) thick. A 7.8 μm thick Nylon 6,6 film was used as the topcoat 3 of this invention. This topcoat was first treated with Carboset ®XPD-1294 adhesive described in Example 3 and then applied over phosphor layer 2 by lamination (Riston ®HRL-24 laminator at 135° C. and 0.4 m/minute with air assist.) This screen element, representing the invention, was tested first using the device shown in FIG. 2 and also used to expose a standard medical X-ray photographic film element to test for sensitometry. The average COF was 0.20, the static decay ½ time at 60% R.H. was 2.0 seconds and the speed and resolution of the film exposed therewith were equivalent to the control, indicating that the topcoat would provide superior protection with no loss of sensitometry.

EXAMPLE 5

A commercial grade, dimensionally stable, polyethylene terephthalate film of ca. 0.010 inch (0.25 mm) thickness and filled with $TiO_2$ to provide reflection, was used as support to prepare the screens of this example. $YTaO_4$:Nb phosphor dispersed in an acrylic polymer binder was applied thereon as a layer, 0.006 inch (0.15 mm) thick. The nylon films listed in Table 5 below were used as the topcoat film of this invention. These topcoat films were first treated with Carboset ®XPD-1294 adhesive as described in Example 3 and then applied over the phosphor layer by lamination (Riston ®HRL-24 laminator at 135° C. and 0.4 m/minute with air assist). Each screen element was tested using the device shown in FIG. 2. The average COF and remarks concerning the screen elements are set out in Table 5 below.

TABLE 5

| | | Film Thickness (μm) | Average COF | Gouge and Abrasion Resistance |
|---|---|---|---|---|
| Polyamide Film | | | | |
| None (control) | | — | 0.40 | Poor |
| Nylon 6,6 Dartek ®[1] | | 7.8 | 0.19 | Excellent |
| Nylon 6,6-extruded | | 15.2 | 0.20 | Very good |
| Nylon 6,12-extruded | | 15.2 | 0.23 | Good |
| Nylon 12,12-extruded | | 15.2 | 0.24 | Satisfactory |
| Nylon-amorphous and blends | | | | |
| Selar ® PA 3426[2] | Nylon 6 | | | |
| 20% | 80% | 25.4* | 0.22 | Excellent |
| 30% | 70% | 25.4* | 0.24 | Excellent |
| 50% | 50% | 25.4* | 0.23 | Excellent |
| 80% | 20% | 25.4* | 0.25 | Excellent |
| 100% | 0% | 12.7 | 0.21 | Excellent |
| 100% | 0% | 25.4* | 0.20 | Excellent |
| Nylon 6 | | 12.7 | 0.21 | Excellent |
| Capran Emblem ® 1200[3] | | | | |
| Nylon 6,6 Dartek ®[1] | | 7.8 | 0.18 | Excellent |

[1]oriented nylon film manufactured by Du Pont Canada Inc., Mississauga, Canada
[2]amorphous nylon manufactured by E. I. du Pont de Nemours and Company, Wilmington, Delaware
[3]biaxially oriented nylon film manufactured by Allied Signal, Inc., Morristown, NJ
*Film thickness does not adversely affect determination of COF. While films of amorphous nylon and blends of amorphous nylon with crystalline nylon are useful in the invention, the thickness should be no greater than about 15.2 μm to provide proper transparency to maintain image quality.

EXAMPLE 6

Example 4 was repeated with the following exceptions: the $YTaO_4$:Nb phosphor acrylic polymer binder layer was coated on the polyamide film and then laminated to the $TiO_2$ filled support which was treated with Carboset ® XPD-1294 adhesive. This screen element was tested as described in Example 4 and gave equivalent results.

I claim:

1. An X-ray intensifying screen comprising a support having thereon a phosphor-binder layer, and a polymeric film adhered to the phosphor-binder layer, the improvement wherein bonded to the phosphor-binder layer is a clear, transparent, flexible, tough, dimensionally stable polyamide film having a thickness of no greater than about 15.2 μm, the X-ray intensifying screen having an average dynamic coefficient of friction in the range of 0.15 to 0.25, and low static susceptibility when the screen is used within a book cassette or an automatic changer therefor, and the surface of the screen has a static decay ½ time less than 6.0 seconds at 60% R.H.

2. An X-ray intensifying screen according to claim 1 wherein the polyamide film has a thickness of about 2.5 μm to 15.2 μm.

3. An X-ray intensifying screen according to claim 1 wherein the average dynamic coefficient of friction is in the range of 0.15 to 0.22.

4. An X-ray intensifying screen according to claim 1 wherein the polyamide layer is adhesively bonded to the phosphor-binder layer with a soluble adhesive selected from the group consisting of water soluble acrylic, solvent soluble acrylic, solvent soluble polyester, solvent soluble polyester polyurethane and water soluble vinyl chloride.

5. An X-ray intensifying screen comprising a support having thereon a phosphor-binder layer, and a polymeric film adhered to the phosphor-binder layer, the improvement wherein bonded to the phosphor-binder layer is a clear, transparent, flexible, tough, dimensionally stable polyamide film having a thickness of no greater than about 15.2 μm selected from the group consisting of nylon 6,6, nylon 6, amorphous nylon, and blends of said nylons, the X-ray intensifying screen having an average dynamic coefficient of friction in the range of 0.15 to 0.25, and low static susceptibility when the screen is used within a book cassette or an automatic changer therefor.

6. An X-ray intensifying screen according to claim 5 wherein the polyamide film has a thickness of about 2.5 μm to 15.2 μm.

7. An X-ray intensifying screen according to claim 5 wherein the average dynamic coefficient of friction is in the range of 0.15 to 0.22.

8. An X-ray intensifying screen according to claim 5 wherein the surface of the screen has a static decay ½ time less than 6.0 seconds at 60% R.H.

9. An X-ray intensifying screen according to claim 5 wherein the polyamide layer is adhesively bonded to the phosphor-binder layer with a soluble adhesive selected from the group consisting of water soluble acrylic, solvent soluble acrylic, solvent soluble polyester, solvent soluble polyester polyurethane and water soluble vinyl chloride.

10. An X-ray intensifying screen comprising a support having thereon a phosphor-binder layer and a polymeric film layer adhered to the phosphor-binder layer, the improvement wherein adhesively applied to the phosphor-binder layer is a clear, transparent, flexible, tough, dimensionally stable polyamide film having a thickness of about 2.5 μm to about 12.7 μm, the X-ray intensifying screen having an average dynamic coefficient of friction in the range of 0.15 to 0.22 and a static decay ½ time less than 3.0 seconds at 60% R.H.

* * * * *